US005490756A

United States Patent [19]

Reichert et al.

[11] Patent Number: 5,490,756

[45] Date of Patent: Feb. 13, 1996

[54] MANIPULATION AND TRANSPORT DEVICE FOR ROLLED MATERIALS

[75] Inventors: Ronald E. Reichert, Orem; Donald Beuch, Midvale, both of Utah

[73] Assignee: RTI Corporation, Orem, Utah

[21] Appl. No.: 55,219

[22] Filed: Apr. 29, 1993

[51] Int. Cl.[6] ..... B66C 1/54

[52] U.S. Cl. ..... 414/619; 414/620; 414/626; 414/910; 414/911

[58] Field of Search ..... 414/619–620, 414/659–660, 663, 667, 671, 684, 738, 910, 626, 911, 607

[56] References Cited

U.S. PATENT DOCUMENTS

| | | | |
|---|---|---|---|
| 2,477,167 | 7/1949 | Bliss | 414/663 |
| 3,016,158 | 1/1962 | Horton | 414/620 |
| 3,134,620 | 5/1964 | Blaisdell | 414/626 X |
| 3,730,368 | 5/1973 | Dalglish | 414/626 X |
| 3,734,328 | 5/1973 | Dalglish | 414/684 X |
| 4,183,710 | 1/1980 | Burdick | 414/671 |
| 4,213,727 | 7/1980 | Lighthipe, Jr. | 414/738 X |
| 4,279,567 | 7/1981 | Thompson | 414/910 X |
| 4,687,244 | 8/1987 | Cullen et al. | 414/684 X |
| 4,718,813 | 1/1988 | Kehlenbach | 414/684 |
| 5,161,931 | 11/1992 | Mayer | 414/667 X |

*Primary Examiner*—F. J. Bartuska
*Assistant Examiner*—James Keenan
*Attorney, Agent, or Firm*—Thorpe North & Western

[57] ABSTRACT

A device for the lifting, manipulation and transport of heavy rolls of material from shipping containers to/and from production apparatus is disclosed. The device has a mandrel which grips rolled stock at the roll core by means of expansion inside the roll core, and manipulates the rolled stock from its shipping position to a position suitable for placement on the mandrel of equipment to utilize the rolled stock. The device allows for transport of the rolled stock from shipping or storage locations to machinery for use. The device is capable of straddling shipping pallets and the like to allow for positioning the mandrel over the rolled stock while maintaining a relatively low center of gravity. Attached to the vertical lift plate is a second plate which is capable of sideways movement of the rolled stock and the mandrel for horizontal positioning. Primary energy sources are provided by electrically powered hydraulics or manually actuated hydraulics, winches, or lead screws.

2 Claims, 6 Drawing Sheets

MANIPULATION AND TRANSPORT DEVICE FOR ROLLED MATERIALS

BACKGROUND

This invention relates to powdered apparatus for lifting positioning and transporting rolls of material wrapped about hollow cylindrical cores.

Many manufacturing processes require the use of various materials such as packaging, films, plastic, paper, or foil which are normally supplied to machinery in roll form. Modern machinery, which has become larger and faster, requires larger rolls containing more material in order to reduce the need for shut down or production delays during roll changes of rolled materials. These larger rolls, up to 24 inches in width, and 40 inches in diameter, can weigh over 800 pounds. The preferred method of roll shipment is on a pallet, or other similar support or container, with the roll core in the vertical position (core vertical). Shipment of the roll in an upright position (core horizontal) requires blocking or chocking the rolls to prevent instability, and often results in damage to the material or machinery upon use, due to imbalance created during transport or storage.

Nearly all machinery requires the roll to be in the core horizontal position during use. As these large rolls are far too heavy for human manipulation, a mechanical method of manipulating rolls from the preferred shipping position (core vertical), to the use position (core horizontal), and transporting them from the storage or shipping site to the machinery is warranted. This mechanical method, in the past, has generally been by the use of general purpose machines such as fork lifts, but this often results in damage to the material or to the roll.

After the rolled material has been removed from storage or shipping and transported to the site of use, positioning on a mandrel of utilization of machinery has often been accomplished in a make-shift way. While fork lifts have the means to manipulate an object vertically, they often do not have the capability of moving an object in other directions. This may result in attempts to manually manipulate the roll stock from the conventional device to the mandrel, often resulting in damage to the roll stock and even injury to technicians.

Another drawback with the use of general purpose machines, such as fork lifts is that they are relatively expensive. More flexible, safer, and cleaner general purpose designs are increasingly expensive, and this kind of expense is not warranted when a commercial application only requires the efficient manipulation and transport of heavy rolled materials.

SUMMARY OF THE INVENTION

It is an object of this invention to provide a device for the efficient manipulation and transport of rolled materials from their typical storage position (core vertical), to their typical use position (core horizontal).

It is another object of the invention to provide a device capable of gripping the interior surface of the roll core so as not to damage the material wound on the exterior surface of the core.

It is a further object of the invention to provide a device capable of selectively manipulating rolled materials in a variety of directions and orientations in a safe and efficient manner.

Additional objects and advantages of the invention will be set forth in the description which follows, and in part will be apparent from the description. The objects and advantages of the invention may be realized and obtained by means of the instruments and combinations particularly pointed out in the appended claims.

The above and other objects of the invention are realized in a specific illustrative embodiment of a manipulation and transport device for rolled materials in which the device includes a base, a vertical support mounted on the base, and a horizontal support mounted on the vertical support moveable vertically and horizontally. A mandrel is mounted on the horizontal support for insertion inside the roll core of rolled materials. The mandrel can be manipulated in such a way as to raise the rolled material to a core horizontal position for delivery onto the mandrel of machinery. The entire operation can be accomplished with a relatively simple device powered by a small motor, batteries, and simple hydraulics.

DETAILED DESCRIPTION OF THE DRAWINGS

Figure 1:
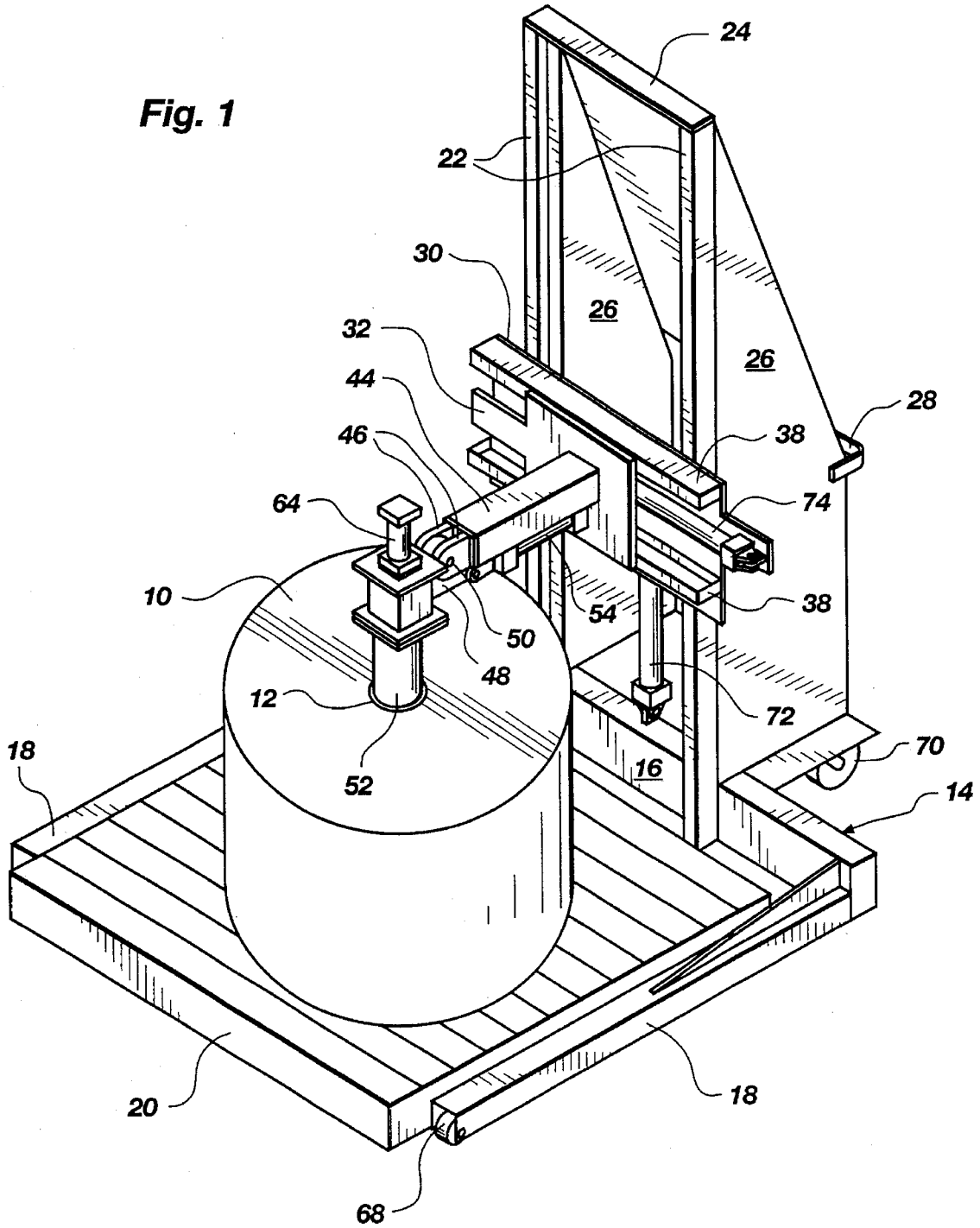
FIG. 1 is a perspective view of a manipulation and transport device for rolled materials made in accordance with the principles of the present invention.

Referring to FIGS. 1 through 4, there is shown one illustrative embodiment of a manipulation and transport device for rolled materials 10 in which the rolled materials have a roll core 12. The device includes a base with a main support member 16 and legs 18 extending therefrom to form a U-shaped configuration which, when positioned to elevate a roll of rolled material from inventory, envelops the roll and other shipping material such as a pallet 20 on three sides. This provides stability during the lift. The base 14 is attached to a vertical support frame having two substantially parallel vertical support members 22 attached at the base to the main support member, and at the top with a superior cross brace 24. The vertical support members may further be supported by side gussets 26 and a posterior cross brace 28. The vertical support members 22 are fashioned from structural channels made of steel or other suitable material, and are constructed so the legs of the channel extend centrally. The utility of this configuration will further be developed hereinafter.

Figure 4:
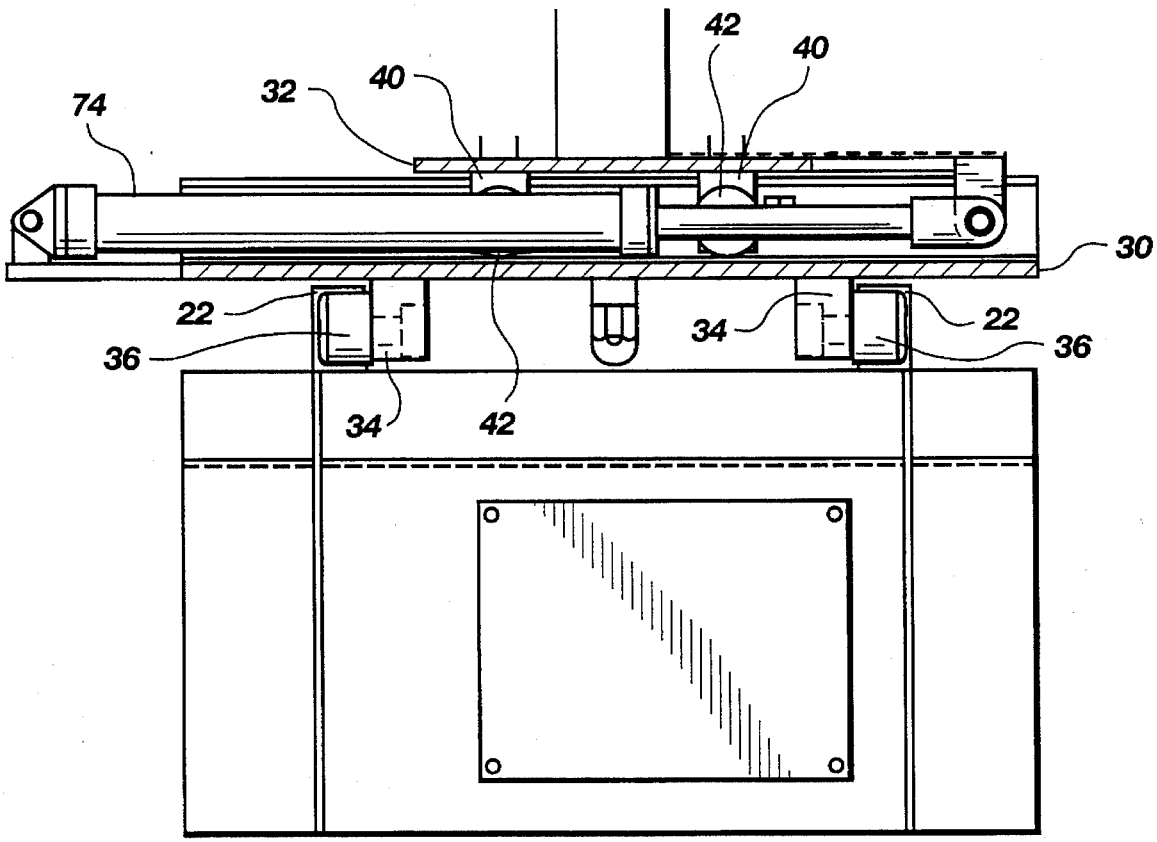
FIG. 4 is a partially cut away, partial top plan view of the manipulation and transport device of FIG. 1.

A horizontal support is movably attached to the vertical support members 22. The horizontal support has two lift plates, a primary lift plate 30 and a secondary lift plate 32. On the back of the primary lift plate are four primary struts 34 on which are disposed four primary bearings 36 (FIG. 4). The four strut-bearing combinations are configured to form a square or rectangle, the height of which is determined by the height of the primary lift plate 30, and the width being determined by the distance between the vertical support members 22. The primary bearings move in the inwardly facing channels of the vertical support members 22 so as to define a vertical path of travel for the primary lift plate 30, which is substantially parallel with the vertical support members 22. Rotational forces on the primary support plate may be further checked by guide bearings (not depicted) which travel at the respective internal bases of the structural channels of the vertical support members 22.

On the front of the primary lift plate 30, are attached two substantially parallel horizontal channels 38 formed of structural steel channels or other suitable material. Disposed at the back of the secondary lift plate are secondary struts 40 and secondary bearings 42 which, in combination with the horizontal channels 38, define a substantially horizontal path of travel for the secondary lift plate 32. Guide bearings (not depicted) may also be provided to further check rotational forces on the secondary lift plate 32.

The lift plates 30 and 32 and other structure attached thereto, and, ultimately the rolled materials 10, are lifted by a hydraulic lift cylinder 72 attached at its base to the main support member 16, and at its top to the primary lift plate 30. This may be a direct connection, but to expand the vertical travel of the apparatus, it may alternatively, be by means of a chain and sprocket (not depicted) in which one end of the chain is attached at the main support member 16, and the other is attached to the primary support plate. The sprocket is attached to the top of the cylinder, which, in turn, is movably attached to the chain in an inverse pulley configuration.

A lift post 44 is disposed on the front of the secondary lift plate. Affixed to the end of the lift post 44 are two outer sections of the main clevis jaws 46. The main clevis jaws are pivotally attached to the main clevis 48 by means of the main clevis pin 50. The main clevis pin 50, may in turn be held in place by snap rings (not depicted), friction, clips, or another pin. It will be appreciated by those skilled in the art that other means of pivotally attaching the two members such as a hinge or a bolt, and other means of holding a pin in place may be used.

Figure 2:
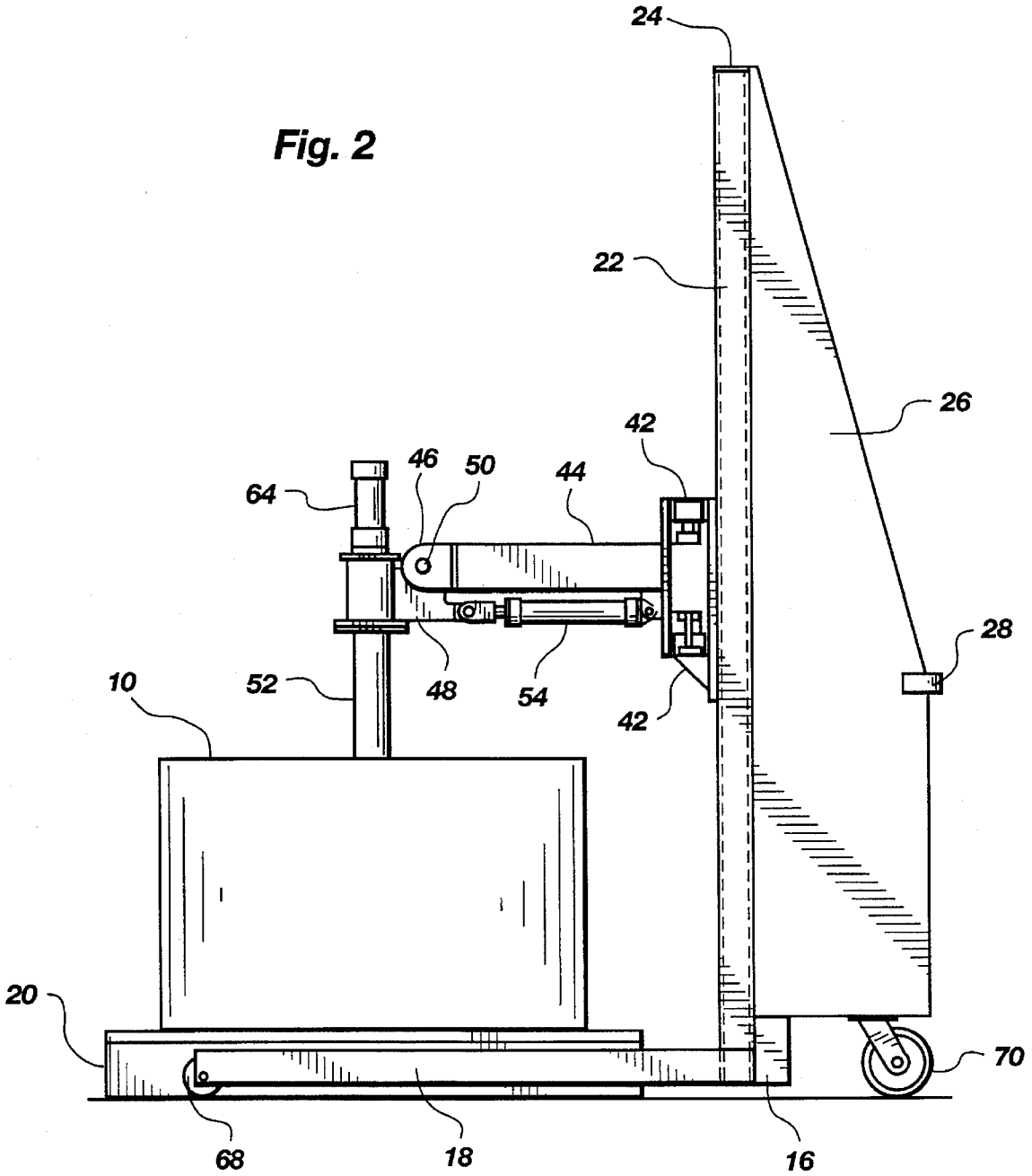
FIG. 2 is a partially cut away, side elevational view of the manipulation and transport device of FIG. 1.
Figure 3:
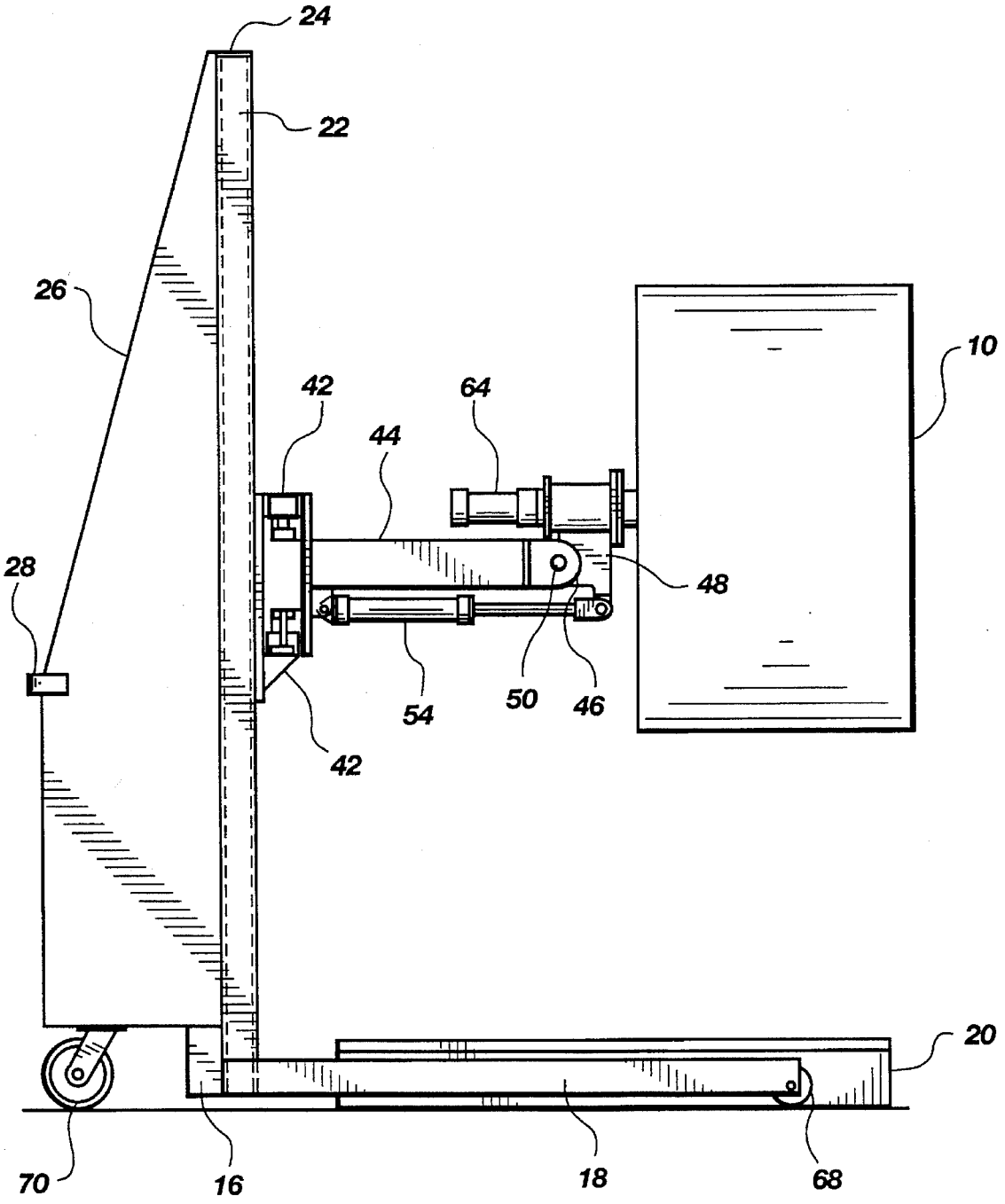
FIG. 3 is a side elevational view of the manipulation and transport device of FIG. 1, with rolled materials born by the device shown in the core horizontal position.

The main clevis 48 is attached to an expandable mandrel 52. The combination of the clevis jaws 46, clevis, 48, and clevis pin 50, allow approximately 90° travel of the expandable mandrel 52, from a substantially vertical position to a substantially horizontal position (FIGS. 2 and 3 respectively). Also attached to the main clevis 48, is the mandrel rotation or manipulation cylinder 54. It will be appreciated by those of skill in the art that alternative means of achieving vertical to horizontal movement of the mandrel can be accomplished by rotating the lift post 44 on its longitudinal axis. Bearings (not depicted) can be mounted within inner (not depicted) and outer posts to facilitate rotation.

Horizontal manipulation of the load is accomplished by means of a horizontal hydraulic cylinder 74 attached at one end to the primary lift plate 30, and at the other end to the secondary lift plate 32. Extension or retraction of the horizontal cylinder 74 causes the plates and their respective structure to move in relation to each other, and, consequently, the rolled materials 10 are moved in relation to the surrounding environment. This horizontal movement of the rolled materials, in combination with vertical movement and the approximately 90° travel of the expandable mandrel, allows relative flexibility in positioning the rolled materials 10 on the mandrel of the target machinery (not depicted).

Figure 5:
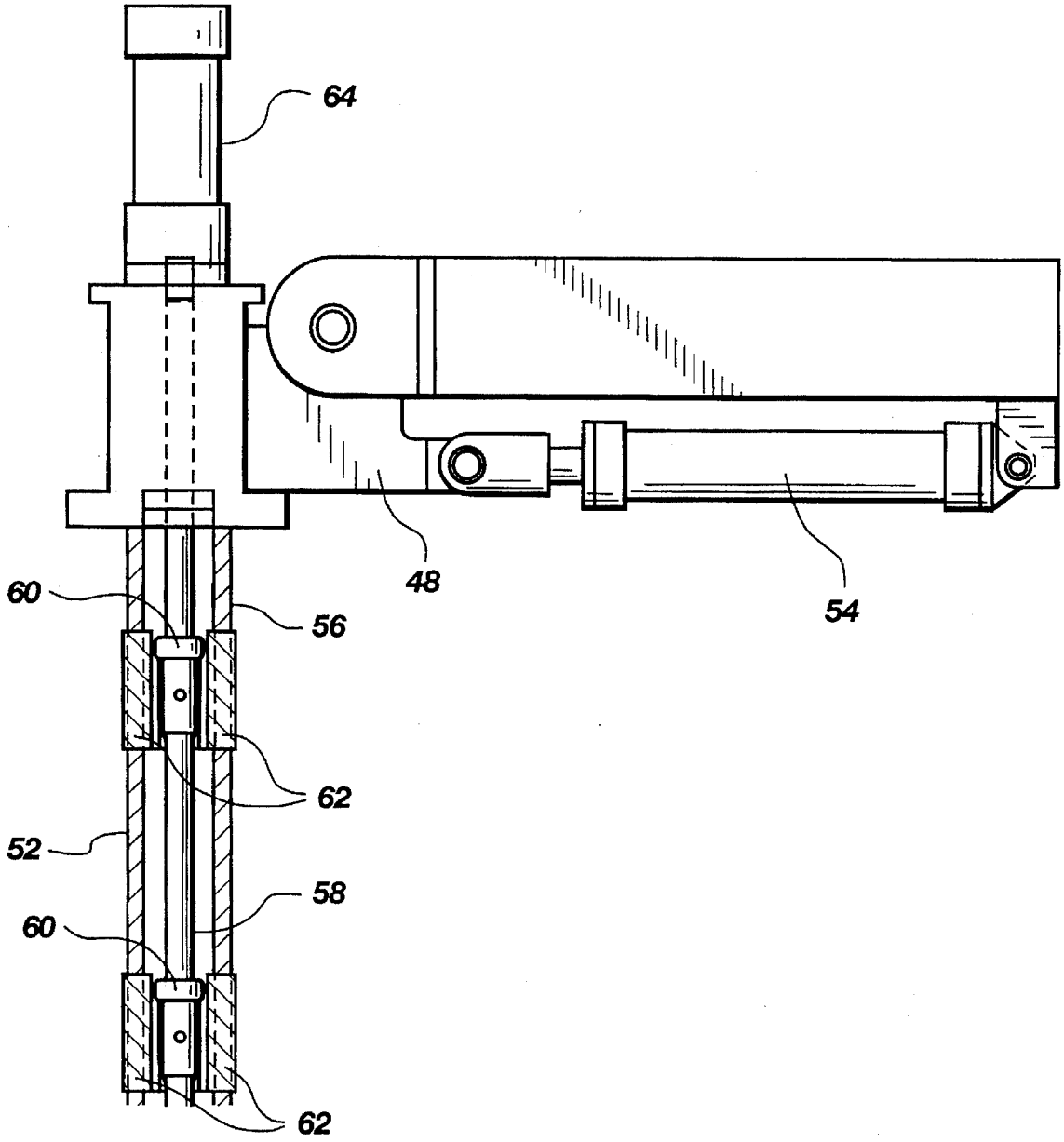
FIG. 5 is a partially cut away, side view of a mandrel and horizontal support structure of the manipulation and transport device of FIG. 1.

Referring to FIG. 5, the mandrel 52 has a mandrel tube 56, a mandrel rod 58, and jaw expanding ramps 60, and expandable jaws 62. The mandrel jaws 62 are free to move in and out of six slots in the mandrel tube 56 which are located in two areas at 120° apart around the mandrel tube circumference. When moved axially through the center of the mandrel tube 56, the mandrel rod 58, on which are axially fixed the jaw ramps 60, forces the jaw ramps 60 against the expandable jaws 62, pushing the jaws radially outward. When the mandrel 52 is positioned inside a roll core 12 of the rolled materials 10, and the jaws 62 are forced outwardly by the jaw ramps 60, the jaws grip the interior of the roll core with sufficient force that the weight of the rolled materials 10 may be lifted by the device. The mandrel rod 58 is moved longitudinally within the mandrel tube 56 by means of a hydraulic cylinder 64. It will be appreciated by those skilled in the art that longitudinal movement of the mandrel rod 58 within the mandrel tube 56 can be accomplished by means of a screw, a cam, or other means.

The device is made transportable by attaching wheels to the underside of the base 14. In the preferred embodiment non-swiveling wheels 68 are attached to the front of the base legs 18, and one or more swiveling wheels 70 are attached at or near the main support member 16 of the base 14.

Figure 6:
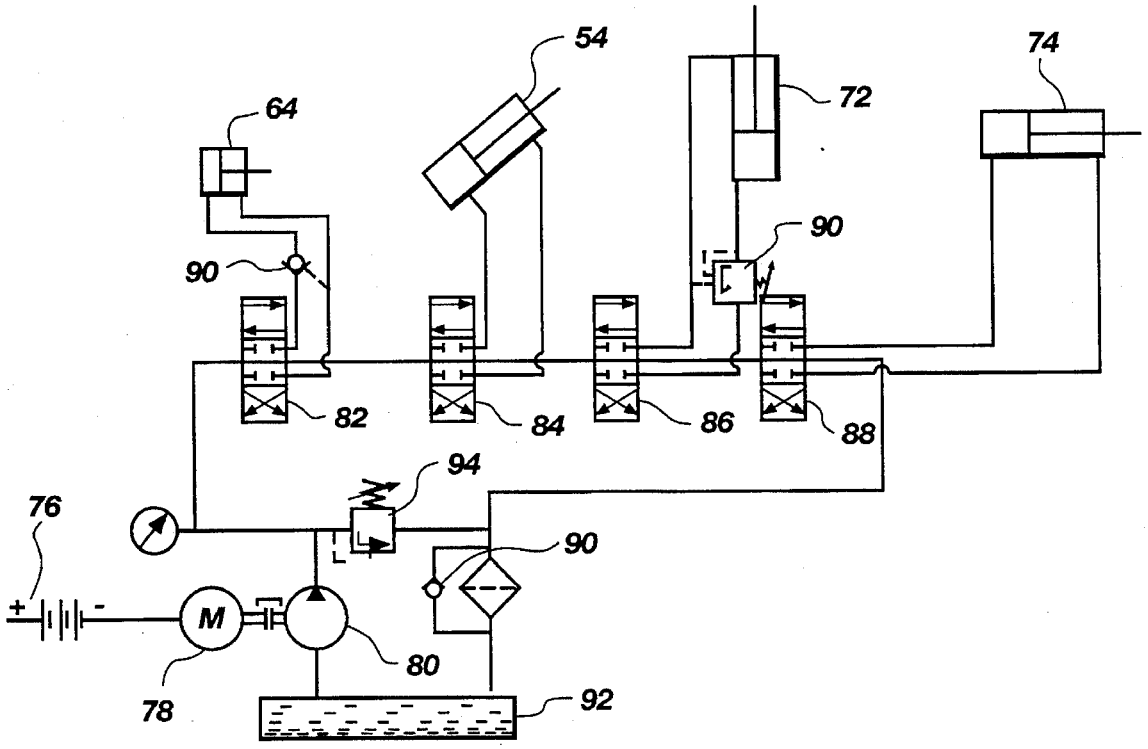
FIG. 6 is a schematic of an exemplary hydraulic system for actuating the manipulation and transport device of FIG. 1.

Referring now to FIG. 6, the hydraulic cylinders described herein to operate the various functions of the device may be actuated by any means known in the art. For example, each cylinder may be actuated by a hand pump; there may be provided a master pump driven by a hand-operated lever; or there may be a remote pump connected to the manipulation and transport device by flexible tubing. In the preferred embodiment, there is provided a master pump operated by a battery driven motor. The batteries 76 are disposed within an area defined by the base 14, the side gussets 26 and the posterior cross brace 28. Also disposed within this area is an electric motor 78, to which the batteries 76 supply electric current, and a hydraulic pump 80. Batteries 76 known to be suitable to this application are 12 volt automotive batteries or the equivalent. A suitable motor 78 is a two (2) horse power 1 KW electric motor operating at 1800 RPM. A pump 80 known to suit the application is 1.5 gallon per minute pump manufactured by Rexroth Corporation under model No. P1-17. Hydraulic fluid is supplied to the pump 80 from an approximately 3 gallon reservoir 92. All hydraulic fluid is transported via standard hydraulic lines. A pressure relief valve 94 is provided in the system and is designed to operate in the 1200–1500 P.S.I range. Compensating check valves 90 are provided to prevent accidental release of a load in transport. A valve stack 82–88 is provided and is disposed on the posterior cross brace 28 (FIG. 1) for convenient access by the operator.

Valve 82 is connected via standard and properly rated tubing to the mandrel cylinder 64, and controls the operation of the expansion function of the mandrel. Valve 84 is connected via standard and properly rated tubing to the manipulation cylinder 54, and controls the operation of the raising and lowering of the mandrel 52 in its approximately 90° arc. Valve 86 is connected via standard and properly rated tubing to the lift cylinder 72, and controls the operation of raising and lowering the load in a vertical manner. Valve 88 is connected via standard and properly rated tubing to the horizontal cylinder 74, and controls the operation of moving the load in a horizontal manner.

It is to be understood that the above-described arrangement is only illustrative of an application of the present invention. Numerous modifications and alternative arrangements may be devised by those skilled in the art without departing from the spirit and scope of the present invention and the appended claims are intended to cover such modifications and arrangements.

What is claimed is:

1. A manipulation and transport device for rolled materials having a central core, said manipulation and transport device comprising:

a U-shaped transportable base comprising two elongate legs and an elongate main support member, the two legs mounted on the main support member to extend substantially horizontally therefrom, the legs substantially parallel to each other to straddle a shipping pallet on two sides, one or more swivel wheels mounted on the main support member, and wheels mounted on the two legs;

two or more vertical support members mounted on and extending upwardly from the main support member, opposing channels formed in the two or more vertical support members to form substantially parallel, substantially vertical guides;

a horizontal support member comprising a first plate having front and back sides, a second plate having front and back sides, and bearings, the first plate movably mounted to the two or more vertical support members, the bearings mounted on the back side of the first plate to travel in the guides of the vertical support members, and the back side of the second plate movably mounted to the front side of the first plate to move thereon in a horizontal direction;

an elongate mandrel having first and second ends and a long axis, said mandrel pivotally mounted at the first end to the front side of the second plate to selectively pivot between a substantially vertical, to a substantially horizontal position, said mandrel further including a plurality of expandable jaws disposed on the mandrel between the first and second ends to selectively radiate outwardly from the long axis of the mandrel to frictionally and releasably engage the central roll core of the rolled materials;

expansion means disposed within the mandrel substantially along its long axis to selectively exert outward pressure on the jaws;

means for causing the horizontal support member to selectively move vertically;

means for causing the second plate of the horizontal support member to selectively move in a horizontal direction; and means for causing the mandrel to selectively pivot.

2. A manipulation and transport device as in claim 1 wherein the means for causing the horizontal support member to selectively move vertically, and the means for causing the mandrel to selectively pivot, are hydraulic cylinder means.

* * * * *